United States Patent [19]

Kartman

[11] 4,083,500

[45] Apr. 11, 1978

[54] TUBE MILL

[75] Inventor: Helge Carl Christian Kartman, Copenhagen Valby, Denmark

[73] Assignee: F. L. Smidth & Co., Cresskill, N.J.

[21] Appl. No.: 743,100

[22] Filed: Nov. 19, 1976

[30] Foreign Application Priority Data

Nov. 21, 1975 United Kingdom ..... 47973/75

[51] Int. Cl.[2] ..... B02C 23/26

[52] U.S. Cl. ..... 241/54; 241/72

[58] Field of Search ..... 241/54, 57, 49, 70, 241/71, 72

[56] References Cited

U.S. PATENT DOCUMENTS

| | | | |
|---|---|---|---|
| 2,031,710 | 2/1936 | Ihlefeldt | 241/72 |
| 2,398,989 | 4/1946 | Agthe | 241/49 |
| 3,289,950 | 12/1966 | Helming et al. | 241/54 |
| 3,537,658 | 11/1970 | Jurgenjanich | 241/49 |

*Primary Examiner*—Granville Y. Custer, Jr.
*Attorney, Agent, or Firm*—Pennie & Edmonds

[57] ABSTRACT

A tube mill is disclosed for drying and grinding moist material which comprises at least one compartment for drying moist material and at least one compartment communicating with the drying compartment for grinding the material. A separating chamber is positioned between the adjacent communicating drying and grinding compartments with means being provided for introducing hot gases and material to the drying compartment so that the material may pass to the separating chamber and the grinding compartment. A sieve drum is centrally positioned within the separating chamber to sieve hot gases and entrained material and to direct the hot gases and entrained material to the interior of the separating chamber while the separating chamber is divided into compartments by a plurality of radial vanes and is subdivided by partitioning members such that gases and entrained material passing through the compartments of the separating chamber travel along a circuitous path which effects a separation of the entrained material while scoop members convey material to the compartments of the separating chamber and the radial vanes direct the material to the successive grinding compartment. A separating chamber for separating gases and entrained material is also disclosed.

14 Claims, 4 Drawing Figures

TUBE MILL

BACKGROUND OF THE INVENTION

1. Field of the Invention

This invention relates to tube mills of the multi-compartment type for drying and grinding moist material such as cement clinker.

2. Description of the Prior Art

Tube mills of the prior art for drying and grinding moist material, in which the drying is performed by a hot stream of gas or air passing through the mill, are well known. Material usually is fed to both ends of such a mill. Moist coarse material is fed to the end of the mill connected to a drying compartment, and a coarse fraction of the dried (or semi-dried material) which exits the drying compartment is fed to the other end of the mill. The mill has a central outlet such as a central discharge chamber for exiting spent gas and dried, ground material. A portion of the material is entrained in the gas leaving the mill.

The discharge chamber is provided with sieving diaphragms to restrict grinding bodies and oversize material from passing to the discharge chamber. The gas and the material entrained in the gas pass from the central outlet, through openings in the mill shell and into a casing which surrounds the discharge chamber. The gas and entrained material then pass to a separator in which the material is separated into two or more fractions. One fraction constitutes the final product and the remainder constitutes a coarse fraction which is returned to the mill for further grinding.

The sieving diaphragms often give rise to difficulties because they restrict the passage of gas and material to the central discharge chamber. Only a limited amount of gas can thus be forced or drawn through the mill. Treatment of wet raw material also involves increased difficulties since the material sticks to the sieving diaphragm and reduces the sieving area.

A prior art drying and grinding process has been proposed in which all (or part) of the gas stream is discharged from the mill after leaving the drying compartment, while the material proceeds to the succeeding grinding compartment. In this process, however, a substantial part of the material is entrained by the gases and is carried out of the mill with the gases. The gases and entrained material pass to a separator from which at least part of the material coarse fraction is returned to the drying compartment, thereby establishing an undesirable circulation of material. Further, the conventional sieving diaphragm restricts the flow area, thereby limiting the amount of gas which can be drawn or forced through the drying compartment.

I have invented a tube mill, having a separating chamber, which avoids these drawbacks and provides an improved approach for drying and grinding moist material.

SUMMARY OF THE INVENTION

A tube mill for drying and grinding moist material is disclosed which comprises at least one compartment for drying moist material and at least one compartment, communicating with the drying compartment, for grinding the material. A separating chamber is positioned between the adjacent communicating drying and grinding compartments. The tube mill further comprises means for introducing hot gases and material at least to the drying compartment so as to entrain at least a portion of the material in the hot gases and to pass material to the separating chamber and grinding compartment. The tube mill also includes sieving means positioned within the separating chamber for sieving hot gases and entrained material and for directing the hot gases and material to the interior of the separating chamber, said sieving means being generally tapered in the direction of material flow. The tube mill further comprises means positioned within the separating chamber for directing gases and entrained material along a circuitous path through the separating chamber so as to impede the flow of gases and entrained material to effect a separation thereof, and for conveying material through the separating chamber to said grinding chamber for grinding.

The separating chamber for this construction allows gases and non-entrained material to pass through the chamber along separate paths. The non-entrained material is lifted up by the conveying means such as scoop members in the form of arcuate members defining radial scoops and caused to slide through the chamber without having to pass through the sieve drum. The gases and entrained material pass through the sieve drum or through openings for the scoop members into the interior of the separating chamber. By directing the gases and entrained material along a circuitous path through the separating chamber and impeding the gas stream, a separation of at least a portion of the entrained material is effected. Consequently, only very fine material is carried out of the mill with the gases. In addition, the sieve drum and the openings for the scoop members increase the free passage area for the gases and allow an increased amount of gases to be drawn or forced through the drying compartment. Adequate drying of the moist material may thereby be performed.

In one embodiment, the separating chamber is an annular chamber surrounding the central sieve drum and bounded upstream and downstream by annular end walls. Radial vanes divide the annular chamber into compartments having material inlet and outlet openings for passage of material from the scoop openings in the upstream annular end wall, through these compartments and to the successive grinding chamber. The compartments also have inlet and outlet openings for the passage of gas from the sieve drum (or from the openings for the scoop members) through the compartments and to the openings in the mill shell. Each of the compartments is subdivided into an upstream and a downstream section by partitioning members such as plate members positioned substantially in a radial plane. The plate members are provided with openings for the free passage of the material along the vanes. The plate members also define gas passages which cause the gases to follow a circuitous path through the separating chamber. That is, the plate members force the gases passing through the sieve drum or through the openings for the scoops in the upstream wall to meander through the divided compartments. The gas flow thus is impeded and deflected several times during its passage through the separation chamber and the gases are effectively relieved of the material entrained therein.

The central sieve drum may be frustoconically configured, defining a generally circular opening at one end portion and a generally circular opening of lesser diameter at the other end portion so as to be tapered towards the grinding compartment. A sieve plate may be positioned within the opening of lesser diameter so as to form an end wall of the sieve drum. The frustoconical sieve drum causes a preferred gas flow through the separating chamber. The sieve plate enables an amount of gas to bypass travel through the divided compartments of the separating chamber and be drawn or forced directly to the grinding compartment. The gas may then serve as ventilating air and conveying air for the ground product which eventually is discharged from the mill. Further, a frustoconical sieve drum provides a large sieving area which increases the passage of gas through the mill.

Having the central sieve drum tapering towards the grinding compartment ensures that material entering the interior of the sieve drum returns to the drying compartment during the rotation of the mill. In addition, material is kept away from direct contact with the sieve plate. In its protected position, the sieve plate does not become clogged with material and the gas may thus pass freely therethrough.

The gas stream passing into the grinding compartment (or compartments) may have some drying effect on the material therein, and thereby serve to prevent coatings from building up in the grinding compartments. The ground material may be conveyed from the outlet of the last grinding compartment by another gas stream and further dried by this gas stream. The material is thereby subjected to a final drying and is conveyed to a separator or a cyclone for separating off the material.

Material collecting in the bottom of a casing surrounding the separating chamber is transferred to a separator or it may be lifted (for example by scoops), and directed into the succeeding grinding compartment by spiral tubes. At the same time, the spiral tubes may serve as feeders to the succeeding grinding compartments of a coarse fraction of material such as that separated off in the drying gas separator.

BRIEF DESCRIPTION OF THE DRAWINGS

Preferred embodiments of the invention are described hereinbelow with reference to the drawings wherein.

DETAILED DESCRIPTION OF THE PREFERRED EMBODIMENTS

Figure 1:
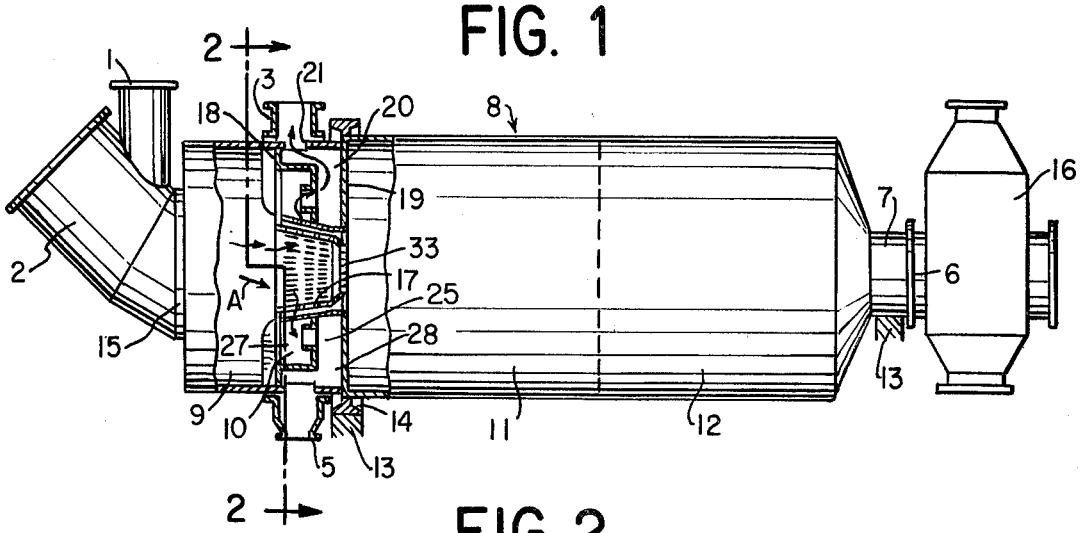
FIG. 1 is a side elevation view, partially in cross-section, of a tube mill according to the present invention.

Referring to FIG. 1, there is illustrated a tube mill having a mill shell 8, a drying compartment 9, a separating chamber 10 and two grinding compartments 11 and 12. The mill shell is mounted rotatably in a trunnion bearing 13 and a slide ring 14 with slide bearings. The drying compartment 9 communicates through an opening 15 with the inlets 1 and 2 for feeding material and gas, respectively. The last grinding compartment 12 communicates with a hollow trunnion 7 and an outlet 6. A receiver 16 for establishing an air or gas borne further conveyance of the ground material also communicates with the outlet 6.

Figure 2:
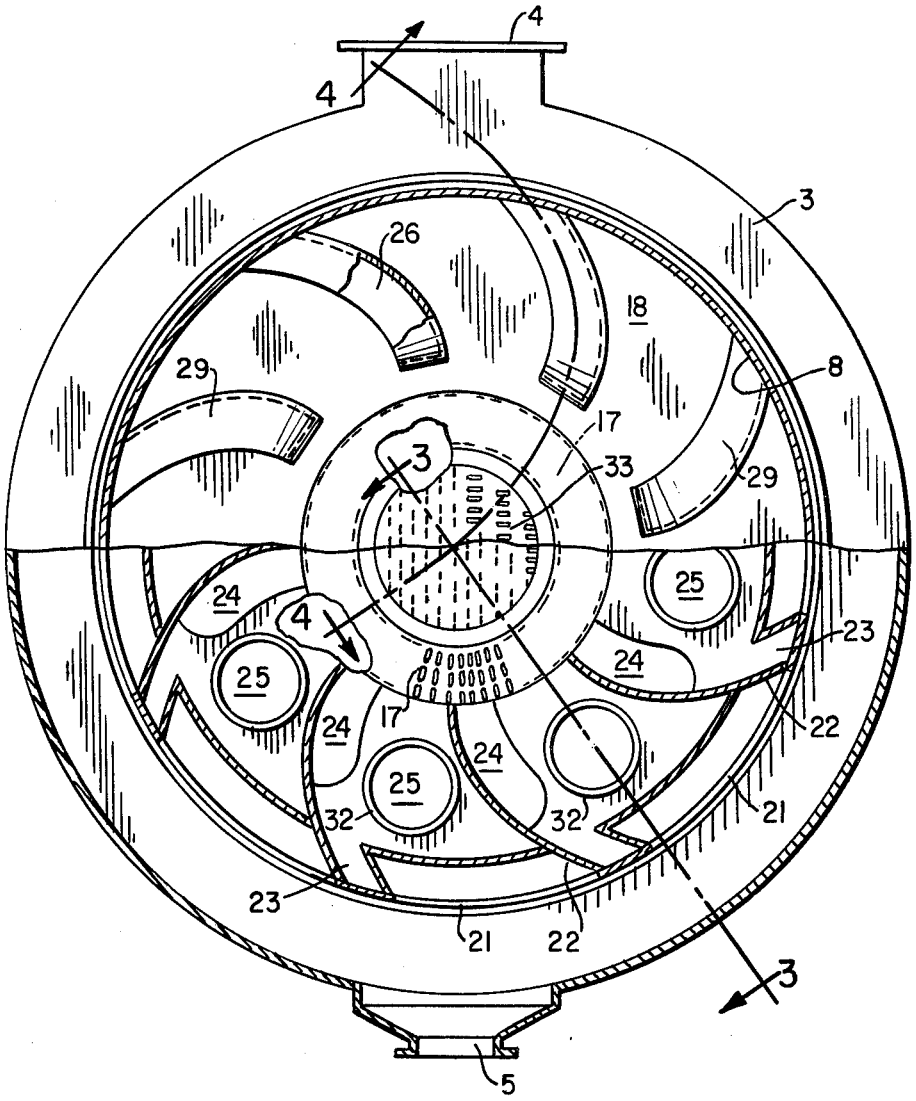
FIG. 2 is a cross-sectional view taken along lines 2—2 of FIG. 1.

As shown in FIGS. 1 and 2, the separating chamber 10, positioned between drying compartment 9 and grinding compartment 11, is surrounded by a stationary casing 3 having an outlet 4 at the top of the casing for removal of gas and a bottom outlet 5 for removal of material. The separating chamber comprises a frustoconical sieve drum 17 centrally positioned within the separating chamber and an upstream annular end wall 18 and a downstream annular end wall 19 defining an annular space 20 which communicates with the casing 3 through peripheral openings 21 in the mill shell 8. The annular space 20 is divided by radial vanes 22 into a plurality of compartments. Each compartment is divided into an upstream section 27 and a downstream section 28 by plates 23 positioned in a radial plane. The plates 23 have openings 24 for the passage of material and openings 25 for the passage of gas.

The radial vanes 22 project through openings 26 defined in the upstream end wall 18, into the drying compartment 9 to form scoop members 29. The downstream sections 28 of the compartments of the annular space 20, are closed by an annular plate 30 located generally towards the sieve drum 17. The downstream compartments 28 communicate with the succeeding grinding compartment 11 through an annular slit 31, defined in the downstream end wall 19. The downstream compartments 28 further communicate with the upstream compartments 27 through the openings 24 and 25, and communicate with the casing 3 through the openings 21 in the mill shell 8.

Figure 3:
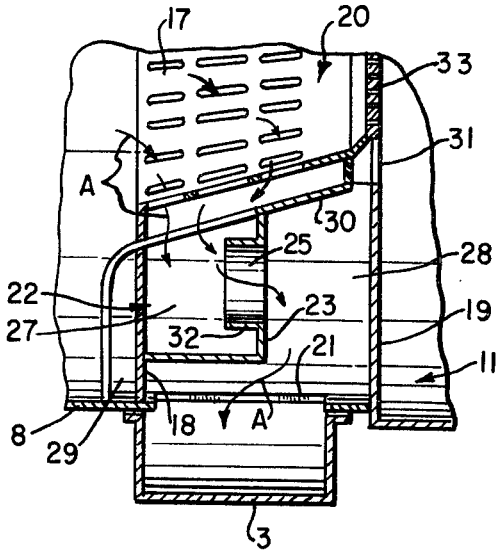
FIG. 3 is a cross-sectional view taken along lines 3—3 of FIG. 1.
Figure 4:
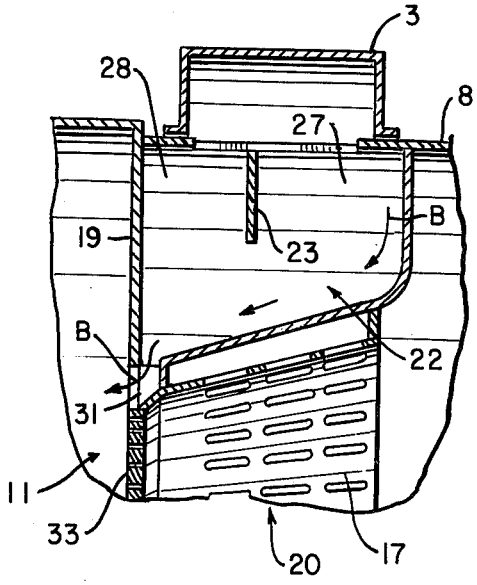
FIG. 4 is a cross-sectional view taken along lines 4—4 of FIG. 1.

Referring now to FIGS. 2, 3 and 4, the moist raw material and drying gas enter the drying compartment 9 and a drying of the material is performed by a heat exchange process. The moist raw material is disintegrated, exposed to the hot gas in a suitable manner (for example, by built-in lifters or stirrers) and thereby entrained in the gases.

The dried or semi-dried material is scooped by the scoop members 29 through openings 26, to the upstream compartments 27 of the separating chamber 10. The material passes along the radial vanes 22, through the openings 24 in the plates 23, through the downstream section of the compartments 28, through the annular slit 31 and into the succeeding grinding compartment 11. The flow of the material through the separating chamber 10 is indicated by the arrows "B" in FIG. 4.

The spent drying gas may pass from the drying compartment 9, through the central sieve drum 17 or through the openings 26, into the upstream compartments 27. From there, the drying gases pass through the openings 25 into the downstream compartments 28, through the gas discharge openings 21 and into the stationary casing 3. During this passage, the gas flow is forced to change its direction several times, and thus, the entrained material is separated from the gases.

In addition, means to further improve the separation of the gases and entrained material may be included in the separating chamber 10, such as by changing the direction of the gas flow additional times or more abruptly. For example, a collar, such as short pipe 32, positioned about the opening 25, as shown in FIG. 3 may be utilized. The flow of the gas through the separating chamber 10 is indicated by the arrows "A" in FIGS. 1 and 3.

The central frustoconical sieve drum 17 is closed at the end which communicates with the succeeding grinding compartment 11 by a sieve plate 33 which allows part of the gas to flow from the sieve drum 17 into the grinding compartment 11.

The construction of the tube mill and the composite diaphragm may be modified in a number of ways without deviating from the invention. For example, the diameter of the drying compartment may be much larger than the diameter of the grinding compartment to allow for an increased passage of drying gas through the drying chamber. The bearings and the supports of the mill and the grinding compartments may be arranged in slide bearings or trunnion bearings in known combinations.

I claim:

1. A tube mill for drying and grinding moist material which comprises:

a. a material drying compartment for introducing hot gases and material therein so as to entrain at least a portion of the material in the hot gases;

b. a grinding compartment communicating with said drying compartment and having a material inlet end portion and a material outlet end portion;

c. a separating chamber communicating said drying compartment with said grinding compartment, said separating chamber defining at least one outlet opening at a peripheral portion for the passage of gases therethrough, said separating chamber having generally annular end wall portions, each defining at least one opening;

d. means for defining a plurality of compartments within said separating chamber and for conveying material from said drying compartment to said separating chamber;

e. means for dividing said compartments into upstream and downstream portions and defining openings therein, said openings being positioned between said upstream and downstream portions to define a circuitous path for passage of gases and entrained material through said compartment portions whereby at least a portion of the entrained material is separated from the gases;

f. a sieve drum having a frustoconical configuration positioned within the separating chamber to receive gases and entrained material from the drying compartment, said sieve drum defining a generally circular opening at one end portion and a generally circular opening of lesser diameter at the other end portion so as to be tapered generally in the direction of the grinding compartment; and g. sieving means positioned within the opening of lesser diameter of the sieve drum.

2. The tube mill according to claim 1 wherein said sieving means comprises at least one sieve plate.

3. The tube mill according to claim 1 wherein said separating chamber is an annular chamber.

4. The tube mill according to claim 2 wherein a first of the annular end wall portions of said separating chamber communicates with the drying compartment and defines a plurality of openings therethrough.

5. The tube mill according to claim 2 wherein the compartment defining means comprises a plurality of generally radial vanes connected to inner circumferential portions of the separating chamber and extending in a generally radial direction inwardly therefrom, said radial vanes also extending through at least one of said openings in the first annular end wall portion and into the drying chamber to form scoop members.

6. The tube mill according to claim 5 wherein the sieve drum is positioned generally centrally within the separating chamber.

7. The tube mill according to claim 6 wherein the sieve drum is frustoconically configured and defines a generally circular opening at one end portion and a generally circular opening of lesser diameter at the other end portion so as to be tapered generally in the direction of the grinding compartment, said opening of lesser diameter having a sieve drum positioned thereover to form an end wall of said sieve drum.

8. The tube mill according to claim 7 wherein the means for dividing said compartments into upstream and downstream portions comprises a plurality of partitioning members extending in a generally radial direction transverse to the radial vanes through the compartments and defining gas passages therethrough.

9. The tube mill according to claim 8 wherein each partitioning member is in the form of a plate member.

10. The tube mill according to claim 6 which further comprises a stationary casing communicating with the separating chamber and adapted to receive at least one of hot gases and material from the separating chamber.

11. The tube mill according to claim 10 wherein at least one of the partitioning members defines a gas passage having deflecting means positioned thereabout to deflect the gases and entrained material which follow a circuitous path through the separating chamber.

12. The tube mill according to claim 11 wherein the deflecting means comprises at least one tube positioned about at least one gas passage of one of the partitioning members.

13. A tube mill for drying and grinding moist material which comprises:

a. a drying compartment having a material inlet end portion and a material outlet end portion, means for introducing hot gases therein so as to entrain at least a portion of the material in the hot gases;

b. a grinding compartment communicating with said drying compartment and having a material inlet end portion and a material outlet end portion;

c. a separating chamber communicating the material outlet end portion of the drying compartment with the material inlet end portion of the grinding compartment, said separating chamber defining a plurality of gas outlet openings in its periphery and having annular end walls, a first annular end wall defining a central opening for gases and entrained material and defining a plurality of openings for material, the other annular end wall defining a central opening for passage of a portion of the gases to the grinding compartment and defining an annular slot for passage of material to the grinding compartment;

d. a sieve drum positioned generally centrally within the separating chamber to receive gases and entrained material, said sieve drum defining a generally circular opening at one end portion and a generally circular opening of lesser diameter at the other end portion so as to be tapered in the direction of material flow;

e. a sieve plate positioned within the opening of lesser diameter of said sieve drum so as to form a downstream end wall of said sieve drum;

f. a plurality of radial vanes connected to inner circumferential portions of the separating chamber and extending through the material openings in the first annular end wall into the drying compartment so as to form scoop members, said radial vanes further extending generally radially inwardly toward the sieve drum so as to form compartments, said compartments defining material inlet and outlet openings and gas inlet and outlet openings; and g. a partitioning member positioned within each compartment to divide each compartment into at least two portions, said partitioning member defining a gas passage and a material passage through each compartment portion with a tube positioned about at least one of the gas passages, said compartments and partitioning members causing the gases and entrained material to meander through the separating chamber and effect a separating of the entrained material from the gases.

14. A separating chamber for use in tube mills which comprises:

a. annular end walls, a first annular end wall defining a central opening for gases and entrained material and defining a plurality of openings for material, the other annular end wall defining a central opening for a portion of the gases and defining an annular slot for material, said separating chamber defining a plurality of outlet openings in its periphery;

b. a sieve drum positioned generally centrally within the separating chamber to receive gases and entrained material, said sieve drum defining a generally circular opening at one end portion and a generally circular opening of lesser diameter at the opposite end portion so as to taper from the first annular end wall toward the other annular end wall, and the opening of lesser diameter having a sieve plate positioned therein;

c. a plurality of scoop members positioned adjacent said separating chamber for conveying material through the material openings in the first annular wall;

d. a plurality of radial vanes connected to inner circumferential portions of the separating chamber and extending generally radially inwardly toward the sieve drum so as to form compartments, said compartments defining material inlet and outlet openings and gas inlet and outlet openings; and e. a partitioning member positioned within each compartment to divide each compartment into at least two portions, said partitioning member defining a gas passage and material passage through each compartment portion with a tube positioned about at least one of the gas passages, said compartments and partitioning members causing the gases and entrained material to follow a circuitous path through the separating chamber and effect a separating of the entrained material from the gases.

* * * * *